US010233814B2

(12) United States Patent
Wasif et al.

(10) Patent No.: US 10,233,814 B2
(45) Date of Patent: Mar. 19, 2019

(54) COMPONENT OF AN EXHAUST SYSTEM

(71) Applicant: Faurecia Emissions Control Technologies, Germany GmbH, Augsburg (DE)

(72) Inventors: Sinan Wasif, Augsburg (DE); Thorsten Linde, Augsburg (DE); Thorsten Keesser, Augsburg (DE)

(73) Assignee: Faurecia Emissions Control Technologies, Germany GmbH (DE)

( * ) Notice: Subject to any disclaimer, the term of this patent is extended or adjusted under 35 U.S.C. 154(b) by 0 days.

(21) Appl. No.: 15/226,982

(22) Filed: Aug. 3, 2016

(65) Prior Publication Data

US 2017/0044965 A1 Feb. 16, 2017

(30) Foreign Application Priority Data

Aug. 10, 2015 (DE) ..... 10 2015 113 159

(51) Int. Cl.
*F01N 13/18* (2010.01)
*F01N 13/08* (2010.01)
*F01N 13/16* (2010.01)

(52) U.S. Cl.
CPC ..... *F01N 13/1811* (2013.01); *F01N 13/08* (2013.01); *F01N 13/16* (2013.01); *F01N 13/1872* (2013.01); *F01N 2470/04* (2013.01); *F01N 2470/06* (2013.01)

(58) Field of Classification Search
CPC ..... F01N 13/1811
USPC ..... 138/92, 98, 106, 108, 109; 123/184.53
See application file for complete search history.

(56) References Cited

U.S. PATENT DOCUMENTS 3,194,355 A * 7/1965 Jeromson, Jr. ..... F16F 9/003 138/30
4,269,231 A * 5/1981 Happer ..... F16L 3/26 138/104
4,854,417 A 8/1989 Uesugi et al.
6,022,054 A * 2/2000 Hemphill ..... B29C 65/5042 285/398
6,378,471 B1 * 4/2002 Yamada ..... F02B 27/02 123/184.53
7,155,902 B2 * 1/2007 Nakagome ..... F01N 3/2842 138/114
7,241,426 B2 * 7/2007 Hardesty ..... B01D 53/9454 422/177
8,123,159 B2 * 2/2012 Hollimon ..... B64D 33/04 239/265.23

(Continued)

FOREIGN PATENT DOCUMENTS

CN 1148136 A 4/1997
CN 202431346 U 9/2012

(Continued)

*Primary Examiner* — Craig M Schneider
*Assistant Examiner* — David R Deal
(74) *Attorney, Agent, or Firm* — Carlson, Gaskey & Olds, P.C.

(57) ABSTRACT

A component of an exhaust system for a combustion engine has a wall in which at least one opening is provided, and a perforated cover which is associated with the opening. A support is provided by which the perforated cover is mounted to the wall of the component. Further, a clearance is provided between the support and the cover such that the cover can shift parallel to the wall of the component.

19 Claims, 5 Drawing Sheets

(56) References Cited

U.S. PATENT DOCUMENTS

| | | | | |
|---|---|---|---|---|
| 8,292,026 | B2 * | 10/2012 | Tauschek | F01N 1/08 181/212 |
| 8,881,863 | B2 | 11/2014 | Abram et al. | |
| 8,925,308 | B2 * | 1/2015 | Hildebrand | F01N 13/1811 60/322 |
| 9,279,357 | B2 | 3/2016 | Saint-Dizier | |
| 2002/0081966 | A1 * | 6/2002 | Achen | F24F 13/084 454/271 |
| 2004/0011731 | A1 * | 1/2004 | Sanguinetti | E03F 1/00 210/483 |
| 2007/0209354 | A1 | 9/2007 | Werber et al. | |
| 2008/0203725 | A1 * | 8/2008 | Willeke | F01N 13/14 285/123.6 |
| 2009/0045006 | A1 | 2/2009 | Kondo et al. | |
| 2009/0084626 | A1 | 4/2009 | Miyazawa | |
| 2014/0230943 | A1 * | 8/2014 | Parrish | F16L 3/12 138/106 |

FOREIGN PATENT DOCUMENTS

| | | | |
|---|---|---|---|
| DE | 19639079 | A1 | 3/1998 |
| DE | 102007030296 | A1 | 1/2009 |
| DE | 102012014620 | | 1/2014 |
| EP | 1081370 | A2 | 3/2001 |
| EP | 0831211 | B1 | 9/2010 |
| WO | 2007146770 | A1 | 12/2007 |
| WO | 2014126548 | | 8/2014 |

* cited by examiner

COMPONENT OF AN EXHAUST SYSTEM

RELATED APPLICATION

This application claims priority to German Application Serial No. 10 2015 113 159.5, filed Aug. 10, 2015.

TECHNICAL FIELD

The invention relates to a component of an exhaust system for a combustion engine, having a wall in which at least one opening is provided, and a perforated cover which is associated with the opening. The component may be an exhaust-gas-ducting tube or a housing, in which a catalyst substrate or a particle filter is for example arranged, or may be a muffler. The combustion engine is in particular an engine for a motor vehicle working in accordance with the Otto-principle or the Diesel-principle.

BACKGROUND

Examples for such a component can be found in documents DE 10 2012 014 620 A1 and WO 2014/126548 A1. The opening in the wall of the component which is covered by the perforated cover serves to the sound damping when exhaust gas flows through the component. Due to the (although low) gas flow rate through the opening, fewer resonances are generated by stationary waves within the component. Turbulent currents in the exhaust gas flow can furthermore be dampened and be converted into laminar currents, which reduce the proportion of high frequencies in the frequency spectrum.

The perforated cover may be a metal sheet provided with a large number of small openings. The perforation degree is in the order of 1 to a maximum of 10% of the entire surface of the cover, in particular in the range of 1 to 3%. Each single pore has an area size in the range of 0.02 to 2 $mm^2$, preferably in the range of 0.04 to 1 $mm^2$.

The perforated cover is usually welded to the wall of the exhaust-gas-ducting component. A reliable fastening with the desired high lifetime is thus obtained. However, it became apparent that high loads may act onto the perforated cover when thermal expansions occur.

The higher the difference of the thermal expansion coefficients is, the more critical is the effect of the loads of the perforated cover. One example for different thermal expansions are ferritic steel alloys that can be used for the exhaust-gas-ducting components, and austenitic steel alloys, which are used for the perforated cover.

The object of the invention is to develop the known component such that no difficulties occur in case of thermal expansions of the component and/or of the cover.

SUMMARY

A support is provided according to the invention, by which a perforated cover is mounted to a wall of a component. A clearance between the support and the cover is provided such that the cover can shift parallel to the wall of the component. The invention is based on the basic idea to fasten the perforated cover to the component such that expansions due to heat and displacements resulting therefrom with respect to the support and the wall of the component are permitted. The perforated cover is here mounted to the component using a kind of push fit.

Preferably, the support is a frame which is mounted to the wall and surrounds the outer edge of the cover. In this way, the perforated cover is reliably fastened to the component in all directions.

To reliably limit the maximum possible displacement of the perforated cover in any direction, the clearance is preferably formed between an end face of the cover and a stop face of the support arranged at a distance opposite the end face. Even if it is sufficient that the clearance is present on one side of the cover, a clearance is ideally present in any direction to permit the expansion of the cover in any direction.

According to one embodiment of the invention, the support has a mounting portion which is mounted to the wall, and a retaining portion for the cover which is offset with respect to the mounting portion as seen in a direction perpendicular to the wall. The stop face is formed by a step at the transition from the mounting portion to the retaining portion. In this embodiment, the cover is fixed between the wall and a face of the mounting portion turned towards the wall. The support can thus be realized in single-layered manner.

Preferably, the support is a stamped sheet-metal component. A manufacture of the support with little effort and in a cost-effective manner is therefore possible.

The mounting portion can be welded to the wall of the exhaust-gas-ducting component. Several spot welds can be sufficient to accomplish this. It can also be provided that the mounting portion is connected to the wall using a peripheral weld seam. This weld seam then preferably runs along the outer edge of the support.

It is preferably provided that the cover is held in a prestressed manner between the mounting portion and the wall. On the one hand, the prestress prevents an uncontrolled reciprocating movement of the cover between opposite stop faces within the predefined clearance. This could lead to a premature wear due to the thus occurring relative displacement between the cover and the wall or the support. On the other hand, it is also ensured with the prestress that the perforated cover cannot vibrate relative to the component and the support. This would lead to undesired noise.

The prestress can be obtained in that in the initial state of the perforated cover, i.e. when it is not yet clamped between the wall of the component and the support, the perforated cover has a shape which differs from the shape of the wall. In a simple case, the perforated is plane, while it is provided for closing an opening in the wall of a pipe. The prestress can also be obtained in that merely the peripheral area of the perforated cover is plastically deformed and, for example, provided with a bead, or is folded.

According to an alternative development, it is provided that at least portions of the support are configured in a double-layered manner. In this embodiment, the perforated cover is entirely received in the support such that a pre-mounted assembly is obtained which is then adapted to be mounted to the component.

It is preferably provided that the support, as seen in section, has a U-shaped cross-section and that the cover is received between the two legs of the support such that the stop face is formed by the inner face of the bent portion between the two legs. Such a bent part can be reliably manufactured at low manufacturing expenses. This particularly applies if the support is a bent sheet-metal component.

It is preferably provided that the two legs are elastically prestressed against each other and against the cover arranged therebetween. Vibration noises due to an undesired relative movement between the perforated cover and the support are thus reliably avoided.

According to one configuration of the invention, it is provided that the support is welded to the wall at the bent portion between the two legs. The access to this area is very good to arrange a weld seam there. The weld seam may here be provided only in sections or be entirely surrounding.

According to one embodiment of the invention, it is provided that the cover is firmly fastened to the support at a point. This can, for example, be realized by a spot-welding point. The punctual fastening of the cover to the support serves as a kind of fixed bearing from which the perforated cover can expand and contract.

According to one configuration of the invention, it is provided that the support has a wall thickness of less than 1 mm, in particular a wall thickness in the order of 0.8 mm. It became apparent that the perforated cover can also be reliably fastened which such thin supports.

The cover can have a wall thickness in the order of 0.3 mm. Such a thin foil has already proved to be sufficiently mechanically resistant. A small wall thickness further simplifies the placement of the perforations.

According to one configuration, it is provided that the wall and the cover are made of materials having different thermal expansions. The wall can be made of a ferritic steel alloy and the cover of an alloy resistant to hot-gas corrosion and cold-condensate corrosion, in particular of a ferritic alloy or of an austenitic steel alloy. Low manufacturing costs for the exhaust-gas-ducting component are thus obtained, whereas a high corrosion resistance is obtained for the cover.

It is preferably provided that the support is also made of a ferritic steel alloy. This also leads to low manufacturing costs.

These and other features may be best understood from the following drawings and specification.

BRIEF DESCRIPTION OF THE DRAWINGS

The invention is described below with reference to two embodiments which are illustrated in the accompanying drawings and which show.

DETAILED DESCRIPTION

Figure 1:
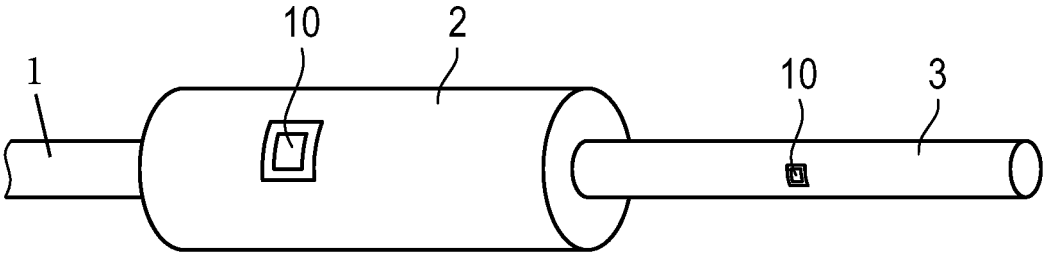
FIG. 1 schematically shows part of an exhaust system having two exhaust-gas-ducting components.

FIG. 1 shows different components of an exhaust system. In this example, a first exhaust pipe 1, a housing 2 and a second exhaust pipe 3 are shown.

The pipes 1 and 3 serve to guide exhaust gas of a combustion engine towards the surroundings. Components that treat the exhaust gas, for example a catalyst substrate or a particle filter, can be arranged in the housing 2. The housing 2 can also be the housing of a muffler.

As far as the components 1, 2, 3 are arranged at a certain distance from exhaust valves of the combustion engine and the temperature of the exhaust gas has therefore already dropped slightly, a ferritic steel alloy can be used as material for the components 1, 2, 3.

In the example embodiment shown, the components 2, 3 are provided with an opening 10. The latter can for example be circular, rectangular, polygonal or oval and have a surface area of some square centimeters. A cover which is fastened to the component by a support is respectively associated with the opening 10. This is explained in detail below.

FIGS. 2 to 8 show a first embodiment. In this embodiment, a perforated cover 12 is used which, generally speaking, is fixed against the wall of the component 3 by a support 14.

Though the example embodiment of the first embodiment relates to a cover 12 which closes an opening 10 in an exhaust-gas-ducting pipe, it has to be understood that the opening 10 can also be provided in a different place of the exhaust system. The opening 10 can be provided in the envelope surface of the housing of the component 2, as shown in FIG. 1, or also in one of the end walls of the component 2.

The perforated cover 12 is made of a metal foil, or of a metal sheet, the wall thickness of which may for example be 0.3 mm. It is provided with a plurality of small perforations, the part of the perforations in the total area of the cover being in the range from 1 to 10% and preferably from 1 to 3%.

The perforations may have a circular shape, a rectangular shape or a different geometry. When the open area thereof is converted into a circular shape, it corresponds to the diameter of the opening in the order of 1 mm to 1.5 mm.

When the dimensions of the openings are smaller than these values, this is also referred to as microperforated cover.

An alloy which is resistant against hot-gas corrosion and cold-condensate corrosion, such as Inconel, is used as material for the cover 12. Preferably, an austenitic steel alloy or an appropriate ferritic alloy can be used.

The wall thickness of the cover is below 1 mm and in particular in the order of 0.5 mm.

These values apply for the initial metal sheet. With regard to cutting or reshaping fabrication methods as can be used for the manufacture of the cover, the cover may possibly be "thicker" after processing, as far as the distance of the surface points is measured, since burs can occur.

The support 14 is configured like a frame and is made of sheet metal. A ferritic steel alloy is preferably used as material, preferably a steel alloy having the same thermal expansion behavior as the component or the wall of the component to which it is connected.

The support 14 has a peripheral mounting portion 16 which is intended to be adapted to the wall of the component 3. A retaining portion 18 is provided within the peripheral mounting portion 16. The retaining portion 18 forms the inner edge of the support 14 and defines a recess which is slightly larger than the opening 10.

Figure 8:
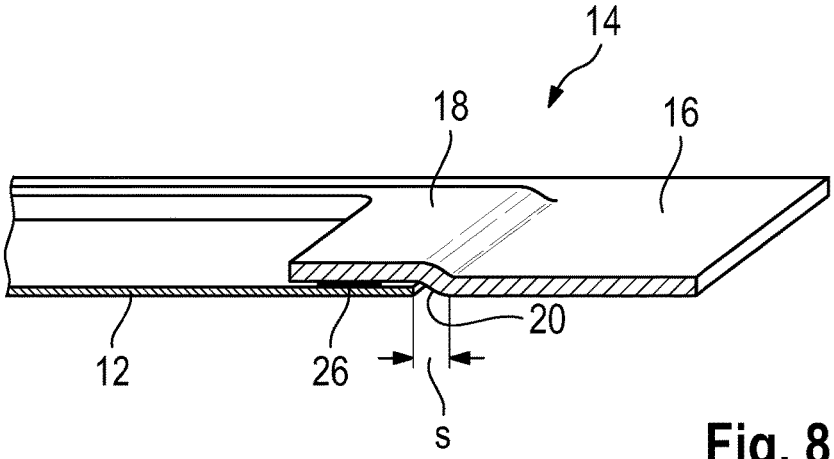
FIG. 8 is a detail of FIG. 7.

As is in particularly visible in FIG. 8, the retaining portion 18 is offset with respect to the mounting portion in a direction perpendicular to the mounting portion 16 and thus also perpendicular to the wall of the component 3. The offset corresponds at least to the thickness of the perforated cover 12. The offset is preferably slightly larger (cf. in particular FIG. 2).

The offset between the retaining portion 18 and the mounting portion 16 can be obtained in that a plane sheet metal blank of the support is stamped appropriately.

Figure 3:
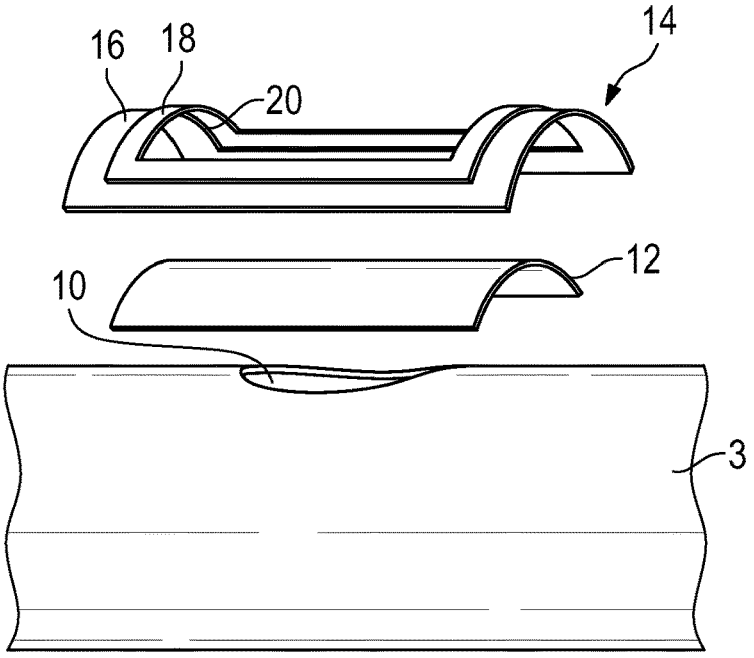
FIG. 3 shows the component of FIG. 2 in a perspective exploded view.
Figure 4:
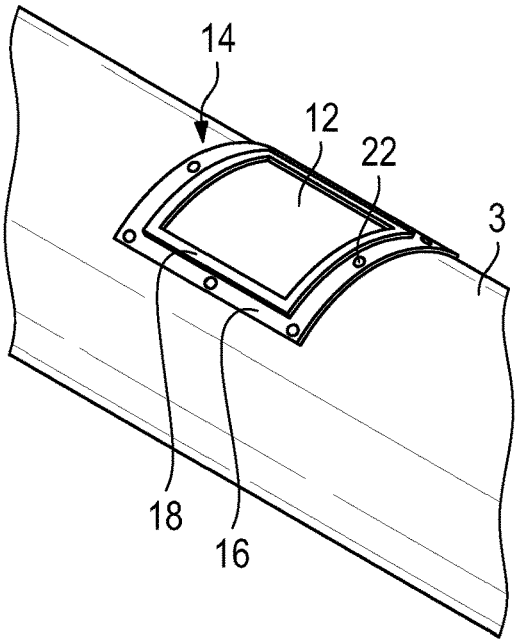
FIG. 4 shows the component of FIG. 2 in a perspective top view.
Figure 5:
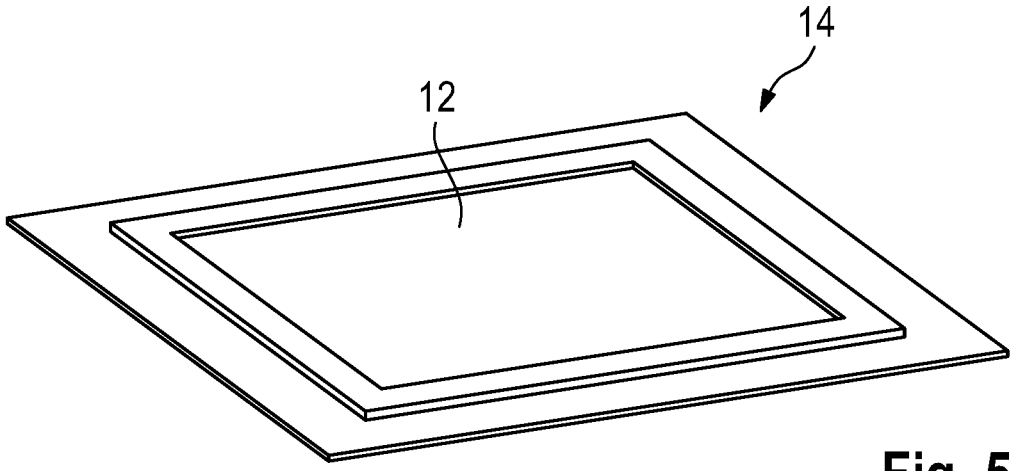
FIG. 5 shows, in an enlarged view, a support with a cover before the mounting to the component.
Figure 6:
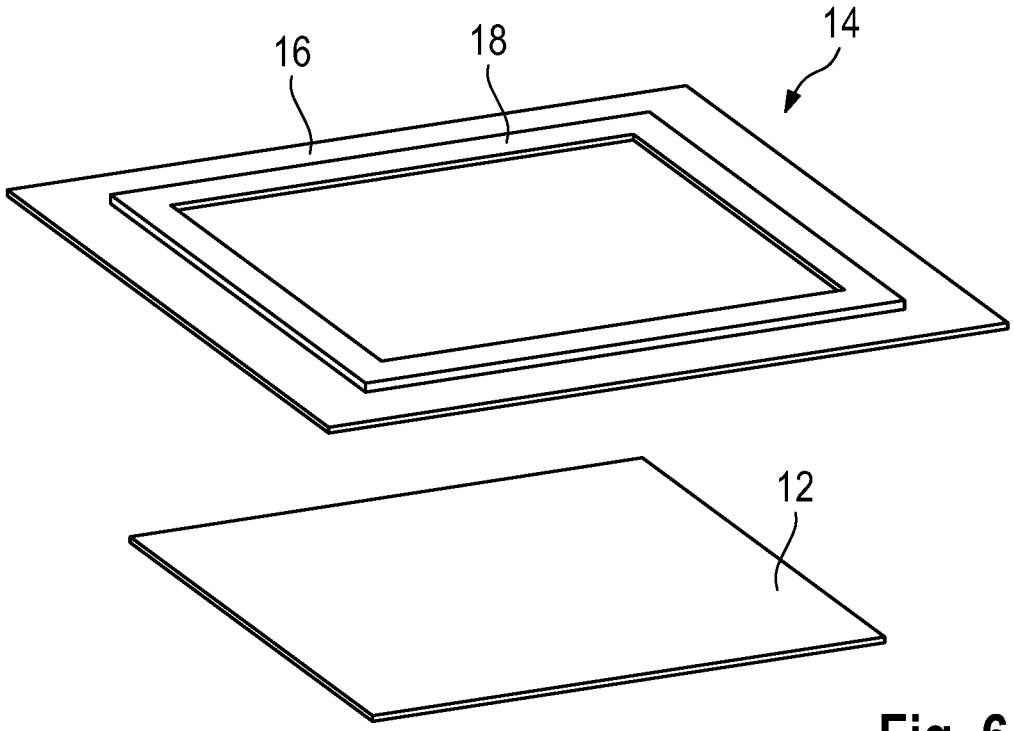
FIG. 6 is an exploded view of the assembly of FIG. 5.
Figure 7:
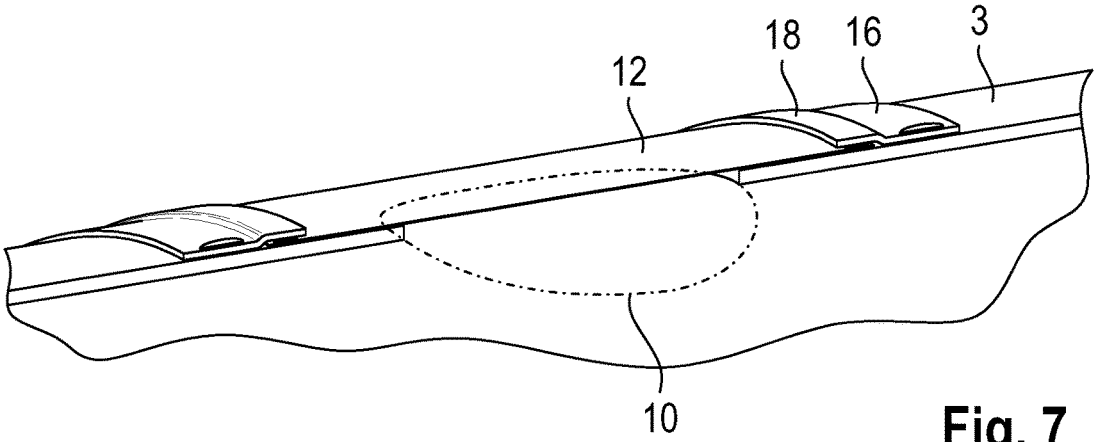
FIG. 7 shows the component of FIG. 2 in a perspective sectional view.

The retaining portion 18 defines an accommodation for the cover 12 which can be arranged in this accommodation (cf. in particular FIGS. 3, 5 and 6). The dimensions of the cover 12 are chosen such that the cover is slightly smaller than the accommodation. In other words, a small clearance s remains between the end faces of the cover 12 and a step 20 formed at the transition between the retaining portion 18 and the mounting portion 16. This clearance s is in the range of 0.2 to 4 mm.

When the support 14 is mounted to the component 3, the perforated cover 12, due to the clearance "s" (FIG. 8), can "wander" below the retaining portion 18 parallel to the wall of the component 3, more specifically until it respectively abuts against the step 20 which acts as stop face on the support for the cover 12.

The support 14 is firmly fastened to the wall of the component 3 by its mounting portion 16. In the example embodiment shown, the mounting portion 16 is welded using several spot-welding points 22 (cf. FIG. 4). It is also possible to use a weld seam 24 extending outside around the mounting portion 16 (cf. FIG. 2).

The support 14 can be mounted to the component 3 in a pre-bent state (cf. FIG. 3) or alternatively also be placed thereon in the plane state (cf. FIG. 5) and then be pressed against the component 3 to follow the contour of the component 3. It is then welded thereto.

As can be seen in FIG. 8, a fixing point 26 is provided at which the cover 12 is fixed to the retaining portion 18. A spot-welding point can be involved here. The fixing point 26 determines the position of the perforated cover 12 relative to the support 14 at this point, such that the cover 12 expands or contracts starting from this point when temperature changes act. A pre-mounted assembly is furthermore formed in this way.

Figure 2:
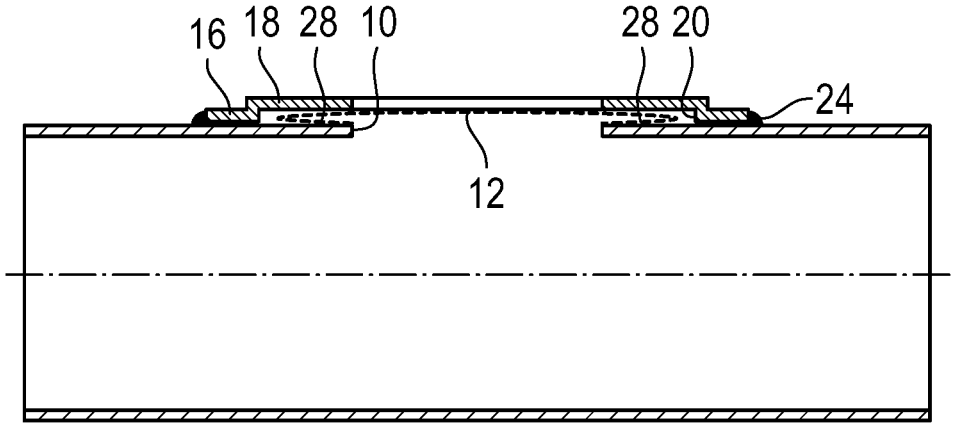
FIG. 2 is a side cross-sectional view of a component with a cover mounted thereto.

The cover 12 is received in an elastically resilient manner between the outer face of the wall of the component 3 and the face of the retaining portion 18 turned towards the component 3. To this end, the cover can be pre-bent or a bead can be stamped along the outer edge of the cover. By way of alternative, as can be seen in FIG. 2, an outer edge 28 of the cover 12 can be folded so that the cover 12 is configured in a double-layered manner in the region of its outer edge. Due to the returning forces of the folded edge portion, the desired resilient prestress is generated here.

On the one hand, the spring prestress is so high that undesired vibration noises due to a movement of the cover 12 relative to the component 3 and the support 14 are avoided. On the other hand, the spring forces are so low that a temperature-related relative movement of the cover 12 with respect to the component 3 and the support 14 is permitted without excessively high mechanical loads acting onto the cover 12.

Figure 9:
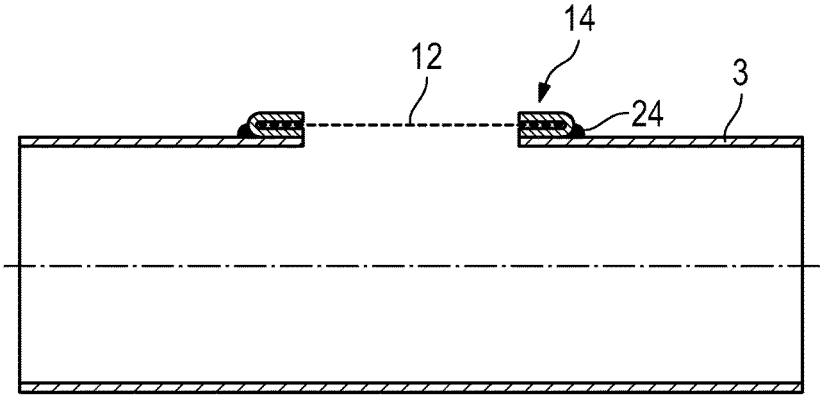
FIG. 9 shows an exhaust-gas-ducting component according to a second embodiment in a sectional view.
Figure 10:
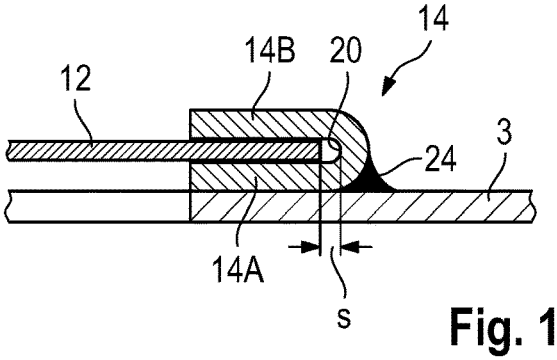
FIG. 10 shows part of FIG. 9 in an enlarged view.
Figure 11:
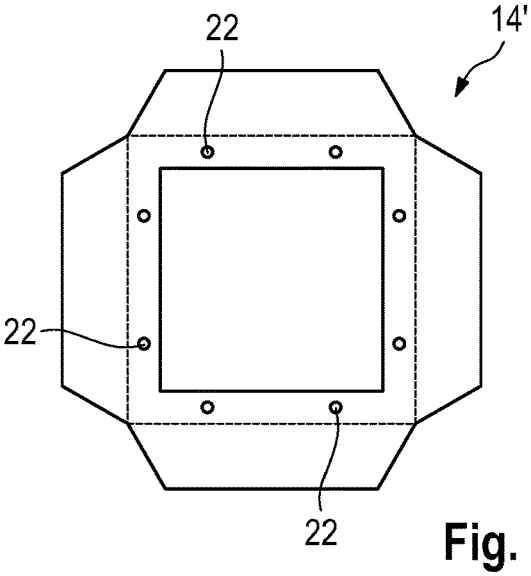
FIG. 11 schematically shows a sheet-metal blank for the support used in the second embodiment.

FIGS. 9 to 11 show a second embodiment. The same reference numbers are used for the components known from the first embodiment, and in this respect, reference is made to the explanations above.

The difference between the first and the second embodiments is that in the second embodiment 14, the support 14 is realized in a double-layered manner. As seen in cross-section perpendicular to an outer edge of the support 14, it has a U-shaped cross-section (cf. FIG. 10), the cover 12 being arranged between the two opposite inner faces of the two legs 14B, 14B. The inner side of the bending point between the two legs 14A, 14*b* here acts as stop face 20.

The support 14 may be made of a sheet metal blank 14' as shown in FIG. 11.

In the same manner as in the first embodiment, the cover 12 in the second embodiment is slightly smaller than the accommodation formed within the support 14 such that a clearance "s" remains between the front faces of the cover 12 and the stop face 20.

In the second embodiment, an elastic prestress also acts between a cover 12 and the support 14. Here, the latter can be generated in that the two legs 14A, 14B of the support 14 receive the cover 12 therebetween like a spring clamp. In addition, or by way of alternative, it can be provided that the outer edge of the cover 12 is folded as known from the first embodiment.

The support 14 along with the cover 12 can form a pre-mounted assembly which is mounted to the component 3. To this end, a weld seam 24 can be used which connects the support 14 to the wall of the component 3 in the region of the bending point between the two legs 14A, 14B. The weld seam 24 can be provided in a surrounding manner or merely in sections.

By way of alternative, it is also possible to first weld the sheet metal blank 14' of the support 14 to the component 3, for example by several spot welds 22, then to place the cover 12 thereon and then to fold the outer tabs such that the support 14 is double-layered.

A fastening of the cover 12 with respect to the support 14 at a fixed point, in particular by a spot-welding point can also be provided in the second embodiment.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A component comprising:

a wall in which at least one opening is provided, a perforated cover covering said opening, wherein said wall and said perforated cover are made of materials having different thermal expansions, said wall is made of a steel alloy and said perforated cover is made of an alloy resistant to hot-gas corrosion and cold-condensate corrosion, a support to mount said perforated cover to said wall of said component, and a clearance provided between said support and said perforated cover such that said perforated cover is adapted for shifting parallel to said wall of said component, and wherein the component comprises an exhaust component of an exhaust system for a combustion engine.

2. The component of claim 1 wherein the clearance is formed between an end face of said perforated cover and a stop face of said support which is arranged at a distance opposite said end face.

3. The component of claim 2 wherein said support has a mounting portion which is mounted to said wall and a retaining portion for said perforated cover which is offset with respect to said mounting portion as seen in a direction perpendicular to said wall, said stop face being formed by a step at a transition from said mounting portion to said retaining portion.

4. The component of claim 3 wherein said support is a stamped sheet-metal component.

5. The component of claim 3 wherein said mounting portion is welded to said wall.

6. The component of claim 3 wherein said perforated cover is held in a prestressed manner between said mounting portion and said wall.

7. The component of claim 1 wherein at least portions of said support are configured in a double-layered manner.

8. The component of claim 7 wherein said support is a bent sheet-metal component.

9. The component of claim 1 wherein said perforated cover is firmly fastened to said support at a point.

10. The component of claim 1 wherein said support has a wall thickness of less than 1.2 mm.

11. The component of claim 1 wherein said perforated cover has a wall thickness in the order of less than 1.0 mm.

12. The component of claim 1 wherein said support is made of a ferritic steel alloy.

13. The component of claim 1 wherein said support has a wall thickness in the order of 0.8 mm.

14. The component of claim 1 wherein said perforated cover has a wall thickness in the order of less than 0.5 mm.

15. The component of claim 1 wherein said alloy is an austenitic steel alloy or a ferritic alloy.

16. A component of an exhaust system for a combustion engine comprising:

a wall in which at least one opening is provided, a perforated cover covering said opening, a support to mount said perforated cover to said wall of said component, wherein said support is a frame which is mounted to said wall and surrounds an outer edge of said perforated cover, and a clearance provided between said support and said perforated cover such that said perforated cover is adapted for shifting parallel to said wall of said component.

17. A component comprising:

a wall in which at least one opening is provided, a perforated cover covering said opening, a support to mount said perforated cover to said wall of said component, wherein at least portions of said support are configured in a double-layered manner, wherein said support, as seen in a cross section, has a U-shaped cross-section with two legs, said perforated cover being received between said two legs of said support such that a stop face is formed by an inner face of a bent portion between said two legs, and a clearance provided between said support and said perforated cover such that said perforated cover is adapted for shifting parallel to said wall of said component, and wherein the component comprises an exhaust component of an exhaust system for a combustion engine.

18. The component of claim 17 wherein said two legs are elastically prestressed against each other and against said perforated cover arranged therebetween.

19. The component of claim 17 wherein said support is welded to said wall at the bent portion between said two legs.

* * * * *